United States Patent [19]

Galgana

[11] Patent Number: 4,962,894

[45] Date of Patent: Oct. 16, 1990

[54] METHOD AND ASSEMBLY FOR CONTROLLING DUST WITHIN A SOLID WASTE DISPOSAL SYSTEM

[75] Inventor: Russell J. Galgana, Clarksville, N.Y.

[73] Assignee: Smith & Mahoney, P.C., Albany, N.Y.

[21] Appl. No.: 384,491

[22] Filed: Jul. 24, 1989

[51] Int. Cl.[5] ..... B02C 19/00

[52] U.S. Cl. ..... 241/30; 241/101.2; 55/96

[58] Field of Search ..... 241/30, 31, 101.2, DIG. 35; 144/252 R, 252 A; 55/1, 96

[56] References Cited

U.S. PATENT DOCUMENTS 4,760,968 8/1988 Binzen ..... 241/101.2

OTHER PUBLICATIONS

*Manual of Recommended Practice,* 13th edition (2d printing 1974), pp. 11–4, 6, 8, 10, 13 and 14.

"Dalamatic Insertable Filters".

*Primary Examiner*—Mark Rosenbaum

*Attorney, Agent, or Firm*—Hoffmann & Baron

[57] ABSTRACT

A method and assembly are provided for controlling dust within a solid waste disposal system. The assembly includes a shredder, a conveyor for transporting solid waste material to the shredder, a second conveyor for transporting shredded solid waste material away from the shredder, a dust collector positioned above the second conveyor, air nozzles or the like for agitating the dust collector so that the dust collected therein is deposited upon the second conveyor, and a nozzle assembly for spraying water onto the dust which is dropped by the dust collector onto the second conveyor. The second conveyor is preferably positioned within a dust plenum which confines the airborne dust to an area where it can be effectively trapped. The method according to the invention includes the steps of introducing solid waste material to a shredder, shredding the solid waste material, discharging shredded solid waste material from the shredder onto a conveyor, trapping dust generated by the shredded solid waste material, discharging the trapped dust upon the conveyor, and spraying the dust discharged onto the conveyor with a liquid.

22 Claims, 4 Drawing Sheets

METHOD AND ASSEMBLY FOR CONTROLLING DUST WITHIN A SOLID WASTE DISPOSAL SYSTEM

BACKGROUND OF THE INVENTION

The field of the invention relates to waste disposal systems for solid waste materials, and more particularly to a method and an assembly for controlling the dust within such systems.

Facilities for treating solid waste materials have become increasingly important as available landfill sites continue to decline. Such facilities may include a receiving station for receiving the raw solid waste, a shredder for shredding the waste to a size which can more easily be combusted, and a boiler in which the shredded waste material is combusted. The energy generated by the boiler can be used to drive a steam turbine to provide electricity and/or to provide steam for industrial use. A magnetic separator is preferably provided between the shredder and the boiler to remove ferrous metals from the shredded waste materials. Recyclable materials and materials not suitable for routine shredding are preferably removed between the receiving station and the shredder.

The generation of dust within solid waste disposal systems is a recognized problem, and has generally been addressed by spraying the solid waste material with water as it is conveyed from one point within the system to another. This approach is inefficient and not completely effective as the spray never contacts much of the solid waste material, thereby allowing the dust therein and thereon to become airborne as soon as the waste material is agitated. The presence of a dust cloud within a solid waste disposal facility makes it difficult for the operating and maintenance personnel to work within the facility, and may also pose a health hazard if dust protectors are not worn by such personnel.

SUMMARY OF THE INVENTION

It is an object of the invention to provide a solid waste disposal system wherein dust is effectively controlled.

It is another object of the invention to provide a solid waste disposal system which includes means for spraying the waste material at the point or points within the system where dust can be most effectively controlled.

Still another object of the invention is to isolate the dust generated by the system within a confined area where it can be gathered and disposed of in an efficient manner.

In accordance with these and other objects of the invention, a solid waste disposal system is provided which includes a shredder, means for transporting solid waste material to the shredder, means for conveying shredded solid waste material away from the shredder, a dust collector positioned above the conveying means, means for passing air or gas through the dust collector such that dust accumulates therein, means for agitating the dust collector such that dust accumulated therein drops onto said conveying means, and means for spraying a liquid onto said dust which is dropped by said dust collector onto said conveying means.

A dust plenum is preferably defined about the conveying means for isolating the dust within a confined area where it can be most effectively trapped by the dust collector. The dust plenum is preferably bounded by a pair of side curtains adjoining each side of the conveying means.

The method according to the invention includes the steps of introducing solid waste material to a shredder, shredding said solid waste material within said shredder, discharging shredded solid waste material from said shredder onto a conveyor, trapping dust generated by said shredded solid waste material above said conveyor, discharging dust trapped above said conveyor onto said conveyor and spraying said trapped dust discharged onto said conveyor with a liquid.

DETAILED DESCRIPTION OF THE INVENTION

Figure 1:
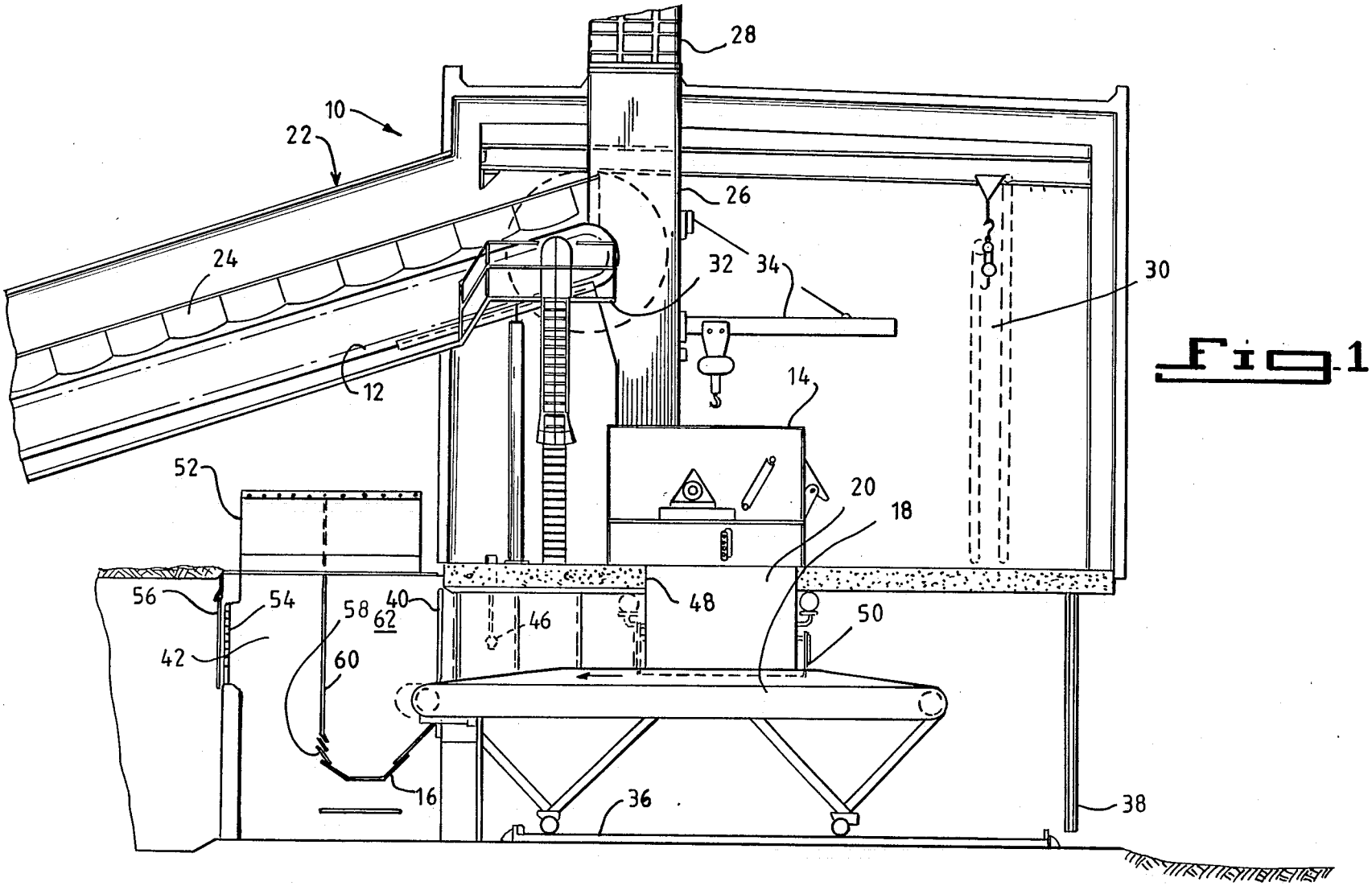
FIG. 1 is a side elevation view of a portion of a waste disposal system in accordance with the invention.

A solid waste disposal system including a dust control assembly is provided by the invention. FIG. 1 illustrates a portion of a solid waste disposal system 10 which includes an infeed conveyor 12, a shredder 14, and a trough conveyor 16 for conveying shredded solid waste material to a magnetic separator (not shown) and/or a boiler (not shown). A shredder discharge conveyor 18 is provided beneath the shredder discharge hopper 20 for transferring shredded waste material to the trough conveyor 16.

The infeed conveyor 12 is positioned within a gallery 22 and bounded on each side by skirtboards 24. This conveyor 12 is made from flat steel plates and is used for conveying the waste material from the receiving station (not shown) to the shredder 14. A picking platform (not shown) may be positioned between the receiving station and the shredder 14. Unshreddable materials may be removed from the infeed conveyor 12 at this platform.

The shredder 14 includes an infeed hopper 26 having a vented upper end to which an explosion vent cage 28 is mounted. Solid waste material is fed to the hopper 26 by the infeed conveyor 12 and is shredded within the shredder 14. The shredder is located within a shredding building 30. A walkway 32 is provided within the building 30 for providing access to the discharge end of the infeed conveyor 12. A maintenance crane 34 is also positioned within the building and secured to the infeed hopper 26.

The shredder discharge conveyor 18 is mounted upon tracks 36 so that it may be moved between an operating position as shown in FIG. 1 and a retracted position. The latter position is preferred for performing maintenance and repair work. A rubber curtain 38 is suspended near one end of the track. Three bulkhead doors 40 are mounted to a conveyor shed 42 which houses the trough conveyor 16. The doors 40 have lower ends adjoining the discharge ends of the shredder discharge conveyor 18. Each door is slidable with respect to the shredder discharge conveyor and is closed when this conveyor is moved to the retracted position. Tracks 44 are provided for mounting the doors. A gas sensor 46 is suspended from the floor 48 of the shredding building for detecting the presence of dangerous gases. The sensor is used in conjunction with a warning and shut-down system forming no part of the present invention. Dust control beneath the shredder discharge hopper 20 is enhanced by the provision of a dust cover 50 secured to the bottom end thereof.

Figure 2:
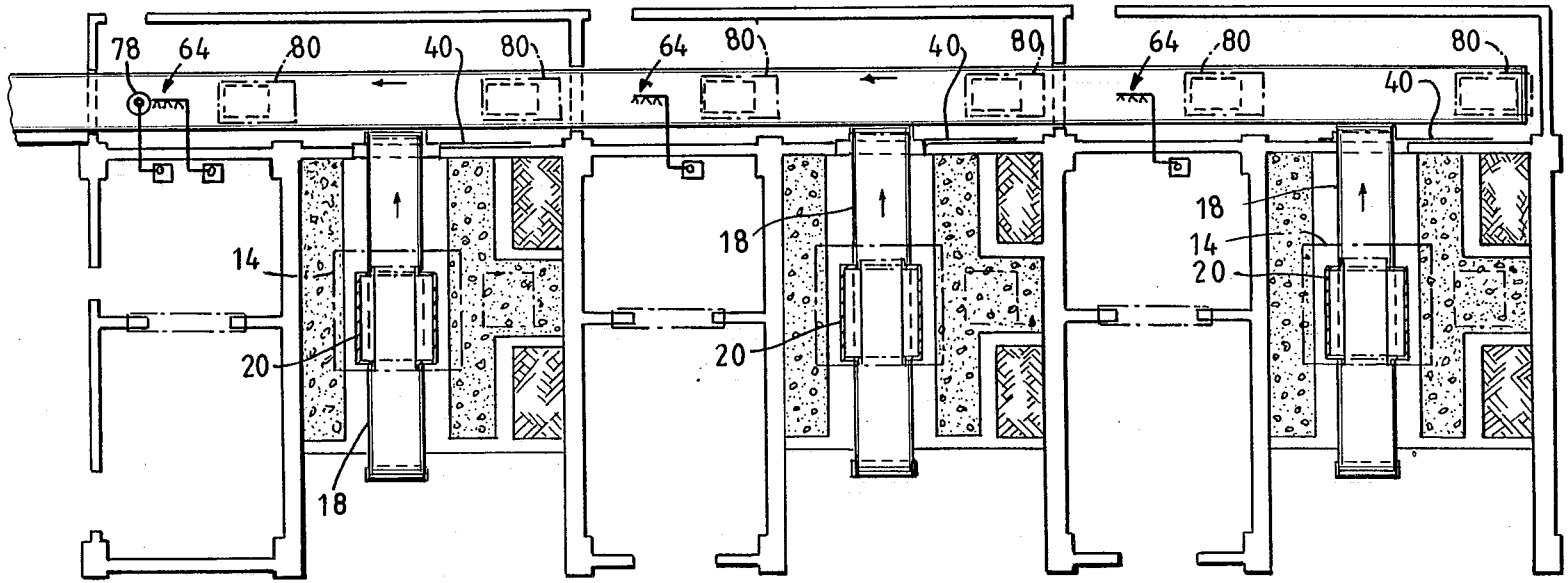
FIG. 2 is a top plan view of the lower level of a waste disposal system in accordance with the invention.
Figure 3:
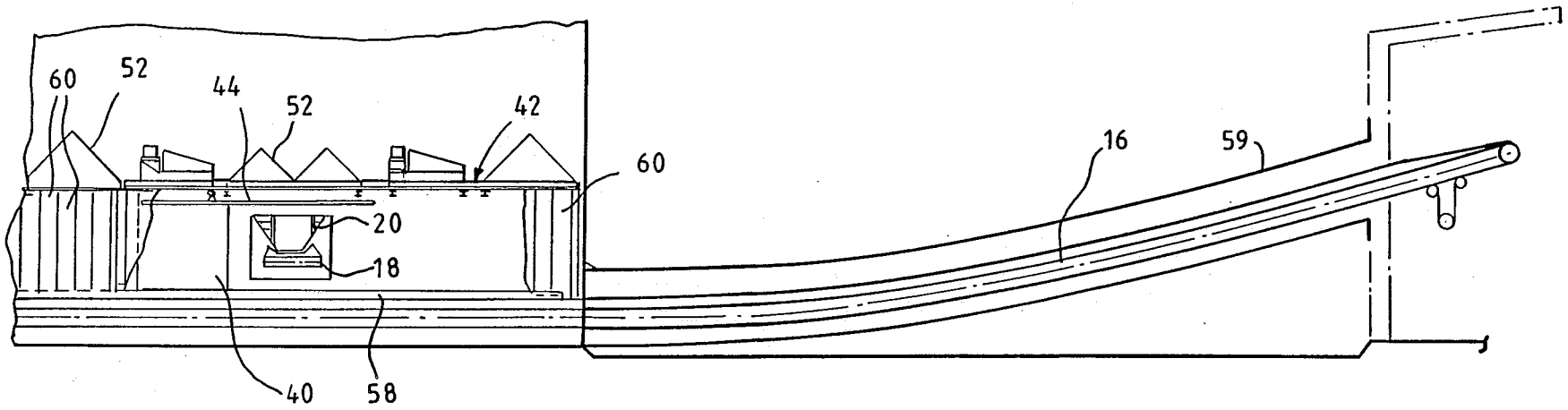
FIG. 3 is a side elevation of a portion of the system shown in FIG. 2.

The conveyor shed 42 is best shown in FIGS. 1–3. It includes a plurality of explosion vents 52, each of which is defined by rubber flaps. The explosion vents may also include internal baffles. Depending upon how many shredders 14 are employed in the waste disposal system, the conveyor shed includes an appropriate number of bulkhead doors 40 to provide access to the trough conveyor 16. The system shown in the Figures includes three shredder 14, as best shown in FIG. 2. Each of the shredders, shredder discharge hoppers, shredder discharge conveyors and other such components used in the system 10 disclosed herein have been identified with the same respective numerals.

Referring again to FIG. 1, the conveyor shed 42 includes a grating 54 provided in a side wall thereof and flaps 56 which ordinarily cover the grating. The flaps 56 and explosion vents 52 are designed to minimize the effects of any explosions which may occur within the system should methane or other explosive gases be ignited.

A pair of continuous skirtboards 58 are provided on each side of the trough conveyor 16. A gallery 59 supports the trough conveyor 16 once it exits the conveyor shed 42. Continuous strip curtains 60 are lapped inside the skirtboards 58. The trough conveyor 16, the strip curtains 60 and the top portion of the conveyor shed 42 define a dust plenum 62 which effectively confines dust generated by the shredded waste material.

Figure 4:
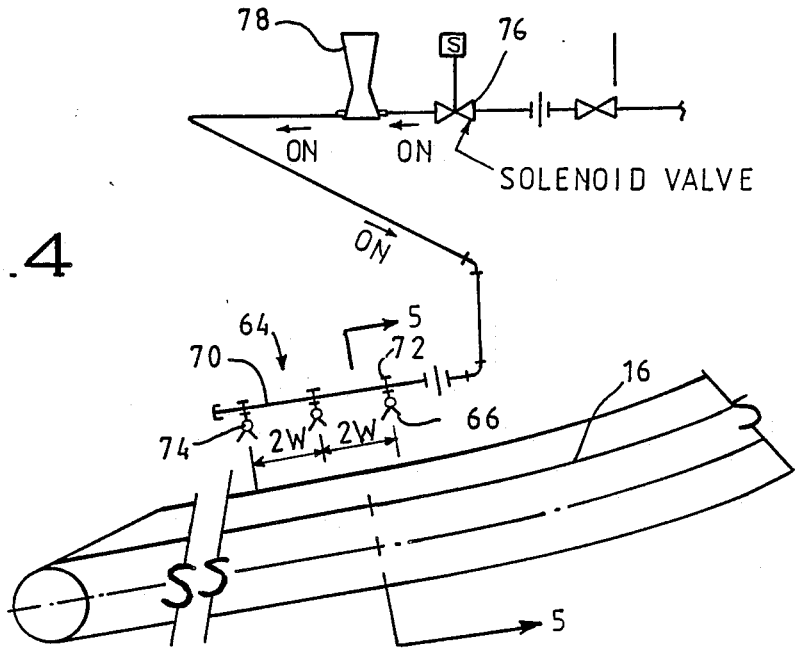
FIG. 4 is a schematic illustration of a dust suppression spraying assembly according to the invention.
Figure 5:
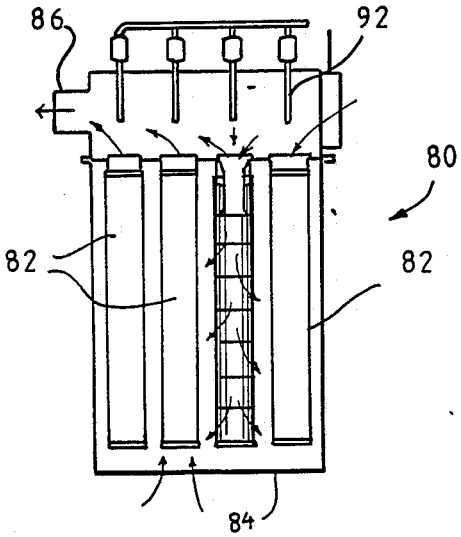
FIG. 5 is a sectional view taken along line 5—5 of FIG. 4.

At least three sets 64 of spray nozzles 66 are mounted to the conveyor shed 42. Each set 64 is positioned following one of three respective pairs of dust collectors which are described hereinafter. As shown in FIGS. 4 and 5, the nozzles 66 are mounted to a pipe manifold 70 by split eyelet connectors 72. The nozzles are connected to adjustable ball fittings 74 which allow the directions of the sprays to be accurately set. Operation of the nozzles is controlled by a solenoid valve 76. A surfactant canister 78 may be added to each manifold should it be desired to add any chemicals to the water which is normally sprayed upon the trough conveyor. The canister contains a soapy material or other chemical capable of reducing the surface tension of the water for more efficient wetting of collected dust.

Referring to FIG. 5, the mounting height H of each nozzle above the conveyor 16 is adjusted so that the width W of the spray pattern equals about two thirds the nominal conveyor width. For example, the spray width W will be about 48", 24" and 18", respectively on 72", 36", and 24" conveyors. The distance between spray nozzles 66 on the pipe manifold 70 is about twice the spray width W.

Six dust collectors 80 are mounted to the roof of the conveyor shed 42. As shown in FIG. 2, a dust collector is positioned on either side of each door opening through which the shredder discharge conveyors 18 deposit shredded solid waste material 68 upon the trough conveyor 16. There are three such door openings in the three-shredder system disclosed herein.

A commercially available dust collector 80 of the type known as a bin vent type reverse-jet, continuous-duty fabric collector is a preferred means of gathering airborne dust within the dust plenum 62. Such collectors operate by passing air or gas through a fabric filter medium at low velocity. Collection of dust takes place by building up a mat of the dust on the dirty air side of the filter media. The mat provides most of the actual filtering capability of the unit. The filter media may take the form of a plurality of tubes which are closed at one end.

Resistance to air flow increases as dust collects on the filter media. The media is accordingly agitated by the intermittent application of reverse jets or pulses of compressed air to dislodge the collected cake.

Figure 6:
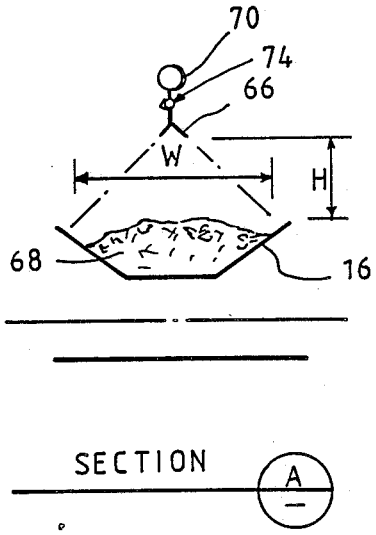
FIG. 6 is a schematical illustration of a fabric collector of the type which may be employed in accordance with the invention.

Referring to FIG. 6, the dust collector 80 includes a plurality of fabric tubes 82, a dirty air inlet 84, a clean air outlet 86, and a plurality of reverse air nozzles 92. In operation, air is drawn out of the clean air outlet 86, thereby causing dirty air to enter the collector housing. As the dirty air is drawn through the fabric tubes, dust collects or "cakes" upon the outside surfaces thereof. Intermittent pulses of compressed air from nozzles 92 into the tubes dislodge the dust cakes from the tubes and cause them to fall onto the trough conveyor 16. Immediately thereafter the dust on the conveyor is wetted by the aforementioned dust sprays to prevent its subsequent escape or dispersion.

In operation, solid waste material from residential, commercial and/or light industrial sources is introduced to the system 10 and deposited upon one of the infeed conveyors 12 by a receiving conveyor (not shown) or other feed mechanism. The waste material is transported through one or more stations by the infeed conveyor 12 associated therewith where selected recyclable materials and unshreddable articles may be removed. It is eventually deposited in the infeed hopper 26 of the shredder 14.

Upon entering the shredder 14, the solid waste material is shredded into smaller pieces which can be combusted within a boiler. The shredded material passes through the shredder discharge hopper 20 onto the shredder discharge conveyor 18 which, like the trough conveyor 16, has a trough-like configuration. The shredder discharge conveyor 18 transports the shredded waste material 68 through one of the doorways within the conveyor shed 42 and onto the trough conveyor 16.

The shredding of the waste material and its transfer to the shredder discharge and trough conveyors creates a dust cloud which can spread throughout the waste treatment facility if not controlled. Dust collectors 80 are accordingly provided for removing airborne dust from the conveyor shed 42 and gathering it in the form of dust mats or cakes. The dust mats or cakes are discharged by the dust collectors onto the trough conveyor 16 where they are sprayed down with water by nozzles 66. By spraying the dust itself rather than just spraying the waste material, the amount of dust spreading throughout the system is significantly reduced.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A solid waste disposal system comprising:
a shredder;
means for transporting solid waste material to said shredder;
means for conveying shredded solid waste material away from said shredder;
means for discharging shredded material from said shredder onto said conveying means;
a dust collector positioned above said conveying means for gathering airborne dust;
means for agitating said dust collector and causing dust gathered thereby to drop upon said conveying means subsequent to the discharging of shredded material onto said conveying means by said means for discharging and such that dust gathered by said dust collector does not reenter said shredder; and
means for spraying said dust dropped upon said conveying means with a liquid spray.

2. A system as defined in claim 1 including a conveyor shed, at least a portion of said conveying means being positioned within said conveyor shed, said dust collector being positioned above said portion of said conveying means within said conveyor shed.

3. A system as defined in claim 2 including vertically oriented side curtains suspended within said conveyor shed and adjoining said conveyor means.

4. A system as defined in claim 2 wherein said conveying means includes a shredder discharge conveyor and a trough conveyor, said shredder discharge conveyor including a discharge end, at least a portion of said trough conveyor being positioned within said conveyor shed, said conveyor shed including an opening for receiving said discharge end of said shredder discharge conveyor.

5. A system as defined in claim 4 including a dust collector positioned on each side of said opening within said conveyor shed.

6. A system as defined in claim 4 including means for moving said shredder discharge conveyor towards or away from said opening within said conveyor shed.

7. A system as described in claim 4 wherein said dust collector is mounted to said conveyor shed above said trough conveyor and offset with respect to said shredder discharge conveyor and said opening.

8. A system as described in claim 7 wherein said means for spraying are mounted to said conveyor shed and positioned immediately adjacent to said dust collector.

9. A system as defined in claim 4 including a door mounted to said conveyor shed for closing said opening.

10. A system as defined in claim 1 wherein said spraying means include a plurality of spray nozzles positioned above said conveying means.

11. A system as defined in claim 10 wherein said conveying means includes a trough conveyor having a width W, said spray nozzles each including means for generating a spray pattern having a width of about two thirds the width W of the trough conveyor.

12. A system as defined in claim 10 including a pipe manifold, each of said spray nozzles being mounted to said pipe manifold.

13. A system as defined in claim 1 wherein said dust collector includes a fabric filter for trapping airborne dust.

14. A system as defined in claim 13 wherein said fabric filter includes a plurality of fabric envelopes.

15. A system as defined in claim 1 including an enclosure defining a dust plenum therein, at least a portion of said conveying means being positioned within said dust plenum, said enclosure including yieldable walls to minimize damage to said enclosure in the event of explosion.

16. A method for handling solid waste material comprising the steps of:
providing a shredder;
introducing solid waste material to said shredder;
shredding said solid waste material within said shredder;
discharging shredded solid waste material from said shredder onto a conveyor;
trapping airborne dust above said conveyor;
depositing trapped dust upon said conveyor subsequent to the step of discharging said shredded solid waste material onto said shredder such that said trapped dust does not reenter said shredder, and
spraying said trapped dust deposited upon said conveyor with a liquid spray.

17. A method as defined in claim 16 including the steps of providing a dust plenum about said conveyor, and trapping airborne dust within said dust plenum.

18. A method as defined in claim 17 wherein said liquid includes water.

19. A method as defined in claim 17 including the steps of providing a fabric dust collector, and drawing air through said fabric dust collector, thereby trapping airborne dust.

20. A method as defined in claim 19 including the step of intermittently agitating said fabric dust collector, thereby causing said fabric dust collector to deposit trapped dust upon said conveyor.

21. A method as defined in claim 20 including the steps of providing an enclosure having yieldable walls about at least a portion of said conveyor and trapping airborne dust within said enclosure.

22. A method as defined in claim 16 including the step of providing a liquid spray upon said conveyor which has a width at its points of contact with said conveyor of about two thirds the width of said conveyor.

* * * * *